US006973764B2

(12) United States Patent
Bordner et al.

(10) Patent No.: US 6,973,764 B2
(45) Date of Patent: Dec. 13, 2005

(54) METHOD OF STACKING AND WRAPPING PROTECTORS FOR SHEET METAL COILS

(75) Inventors: Paul G. Bordner, Pickerington, OH (US); Bret D. Bordner, Groveport, OH (US); Jeffrey G. Kellermann, Arlington Heights, IL (US)

(73) Assignee: ITW Fleetwood-Signode, Addison, IL (US)

( * ) Notice: Subject to any disclaimer, the term of this patent is extended or adjusted under 35 U.S.C. 154(b) by 0 days.

(21) Appl. No.: 10/847,406

(22) Filed: May 17, 2004

(65) Prior Publication Data

US 2004/0211692 A1 Oct. 28, 2004

Related U.S. Application Data

(62) Division of application No. 10/195,754, filed on Jul. 15, 2002, now Pat. No. 6,783,833.

(51) Int. Cl.[7] ..... B65B 25/24; B65B 35/50

(52) U.S. Cl. ..... 53/409; 53/447; 53/532; 53/204; 53/254; 206/445; 414/802

(58) Field of Search ..... 53/409, 447, 532, 53/540, 204, 254; 206/445; 414/802

(56) References Cited

U.S. PATENT DOCUMENTS 3,388,816 A * 6/1968 Lueddeke et al. ..... 414/789.9

* cited by examiner

*Primary Examiner*—Stephen F. Gerrity
(74) *Attorney, Agent, or Firm*—Mueller and Smith, LPA

(57) ABSTRACT

A protector for sheet metal coil is formed of plastic with a flange and sleeve which are joined together at a ridge portion. The protectors incorporate symmetrically disposed groupings of stacking features or components which include a finger within a stacking access opening, a stacking tab, and a stacking opening. The fingers are employed to resiliently engage the inner surface of a core of a coil and incorporate a receiver surface for freely abuttable engagement with a stacking tab of a second protector when arranged in mutual stacking relationship. The stacking openings function for stacking purposes to receive the protruding finger of a next stack protector.

4 Claims, 13 Drawing Sheets

METHOD OF STACKING AND WRAPPING PROTECTORS FOR SHEET METAL COILS

CROSS-REFERENCE TO RELATED APPLICATIONS

This application is a division of U.S. patent application Ser. No. 10/195,754, filed Jul. 15, 2002, now U.S. Pat. No. 6,783,833, the disclosure of which is expressly incorporated herein by reference.

STATEMENT REGARDING FEDERALLY SPONSORED RESEARCH

Not applicable.

BACKGROUND OF THE INVENTION

Steel aluminum, tin or other metals are typically rolled upon a mandrel as a final phase of production. In the steel industry, these mandrels typically have a diameter of 24 or 20 inches, while in the aluminum industry that diameter typically is 16, 20, or 24 inches. The coils, are quite heavy, for example, steel coils generally weighing 60,000 up to 80,000 pounds. To transport or maneuver the coils about the mill and following their delivery to customers, cranes such as overhead cranes having a generally L-shaped or C-shaped engaging implement or a truck with a boom are employed. Typically, the engaging implement incorporates a tong or tongue which slides inside the center region of the coil and engages it for lifting. As is apparent, with the weight at hand, without some protection, the inner layers of the coil as well as the outer edges generally would be damaged. Being highly conscientious with respect to the yield of metal purchased, customers require that such damage be avoided. As a consequence, at the production mill or processor, the multi-layer coils are prepared for crane handling and shipment by the placement of flanged protectors against each coil side which are structured to protect both the edges of the metal and the internal layers of the sheet metal. Generally with this placement procedure, two mill laborers hold the coil protectors in place and they are strapped in place, or, a somewhat elaborate wrapping machine employing a shuttle will wrap both coil and the manually retained protectors with a paper or shrink wrap covering.

Currently utilized coil protectors are, for the most part, fabricated from plastic, and in view of the rigorous environment in which they are used, see only minimal reuse. While plastic recycling procedures have been promulgated, the cost of the protective devices is sought to be controlled through resort to minimizing their weight, i.e., material cost, while maintaining their capability for assuring metal coil integrity. Coil protector cost also is impacted by the cost of their shipment to the coil forming facilities. The protectors necessarily are relatively large and bulksome. To achieve a cost control over their transportation it is desirable that they be stackable prior to packaging and shipping. Such a stacking capability improves the efficiency of both their trucking to coil production facilities and their practical storage when at the site of the user. Practical coil protector stacking should provide a structurally stable column or stack, of no less than about 50 or 60 devices, preferably more, having a height extending within highway transportation regulatory authority mandated limitations.

In the course of producing metal coils, some variations in their open internal diametric extent may be expected. Tolerance variations also will be experienced in the production of plastic coil protectors, which is usually carried out utilizing injection molding procedures. Thus, the design of the protectors must be such as to accommodate tolerance-based variations in the internal diameters of the coils themselves, as well as practical or unavoidable variations experienced in the dimensions of the plastic protectors themselves. Accordingly, coil protector designs must be capable of assuring a proper union with the protected metal coil, as well as assuring that the protectors remain stackable for packaging and shipping purposes.

BRIEF SUMMARY OF THE INVENTION

The present invention is addressed to polymeric protectors as are employed with sheet metal coils. Configured with a flange and sleeve integrally conjoined at a ridge portion, the protectors of the invention will accommodate for tolerancing variations both with respect to their own molded fabrication, as well as those variations encountered in the formation of sheet metal coils. One embodiment provides for the incorporation, inter alia, of relief openings which extend through the ridge portion of their structures. With such an arrangement the circumferential extent of the ridge portions of the protectors may be strained in compression by a wedging or scrunching action asserted upon the sleeve as they may be manually urged into engagement with the internally disposed surface of a coil core. When so inserted, the sleeves are retained within the core without further manual support by integrally formed resilient fingers extending from the sleeves. The noted relief openings serve an additional purpose of contributing to a reduction in the plastic material utilized to mold the protectors. When that material reduction is combined with the corresponding material reductions achieved with a pattern of holes formed in the flange as well as stacking features, an overall cost improving material savings of about 30% is achieved.

The protectors of the invention further enjoy an important stackability attribute which contributes to the economy of their usage. Substantial improvement in the numbers which may be stacked to form a vertically secure protector assemblage is realized with an initial embodiment through the incorporation of groupings of a three component stacking feature. Those components include a stacking tab formed with the sleeve, a stacking tab access opening surmounting a finger configured to provide a stacking receiver surface, and a stacking opening dimensioned to receive a finger structure in stacking relationship. In general, three such groupings are arranged symmetrically about the axis of the flange, the components within each group being mutually spaced apart, for example, in a regular manner.

The corresponding stacking method for this embodiment provides for a positioning of the edge of the sleeve of an initial protector upon a lifting surface such as a pallet or skid. Then, the sleeve of a next protector is inserted within the lifting surface supported sleeve of the initial protector in a manner wherein its stacking tabs engage the receiver surfaces of the fingers of the initial protector. As this occurs, the fingers of this next protector are positioned within the stacking openings of the initial protector.

This stacking procedure is reiterated with a plurality of protectors, each next protector being angularly shifted about the flange axis with respect to the last stacked in position to evolve a somewhat spirally arranged stack vertical assemblage of protectors. For protectors configured for use with sheet steel coils, about 100 may be stacked within a vertical stack height of about 7½ feet. Following such stacking, the stack of protectors is compressively retained within a protective wrap in conjunction with the lifting surface. No substantial protector-to-protector slippage is encountered within the stack such that the stack retains an integrity of verticality throughout its subsequent shipping and storage.

In another embodiment, an annular flange is integrally conjoined with a tapered insertion sleeve having stacking openings incorporating stacking offset openings extending radially into the flange. A stacking tongue is incorporated at the lower end of the stacking opening in combination with a radially outwardly disposed and axially aligned stacking socket. The socket incorporates a receiving chamber configured for receiving the stacking tongue of another protector in stacking relationship. To avoid flange warpage, the protectors may also incorporate a radially outwardly disposed angular reinforcement ridge.

The stacking procedure for this latter embodiment provides for the positioning of the sleeve edge of an initial protector upon a working surface. Then, the sleeve of the next protector is positioned through the upwardly disposed ridge portion of the initial protector and insertion sleeve in a manner wherein the sockets of the next protector pass through the offset openings and the receiving chamber thereof slidably engages the corresponding tongue of the next lower protector.

Other objects of the invention will, in part, be obvious and will, in part, appear hereinafter. The invention, accordingly, comprises the apparatus and method possessing the construction, combination of elements, arrangement of parts and steps which are exemplified in the following detailed description.

For a fuller understanding of the nature and objects of the invention, reference should be had to the following detailed description taken in connection with the accompanying drawings.

DETAILED DESCRIPTION OF THE INVENTION

Mill processing procedures for the production of sheet metal, such as steel or aluminum, generally conclude with the formation of coils of the sheet material. To produce these coils, the sheet metal product is coupled with a mandrel and rolled thereabout to form a coil, following winding of the sheet metal on the core, the sheet metal is retained in position over the mandrel through the use of banding straps or the like. The coil is removed from the mandrel and is subject to a transportation preparatory procedure which enables it to be maneuvered, for example, by cranes such as overhead cranes which lift the coils with an L-shaped tongue or fork. In general, that L-shaped implement is inserted within the now open core of the coil, whereupon the coil is lifted and maneuvered into a next station in the procedure for developing its transportation to the ultimate user.

Prior to this lifting, however, to protect several internal rolls of sheet material next adjacent the open core, one or more mill attendants generally are called upon to insert protectors which engage the coils at opposite sides at the open core area. By virtue of its inherent standing weight, the otherwise circular cross-section of the open core will be distorted to a certain extent and tolerance variations necessarily are present in the formation of the protectors themselves such that the insertion of the protectors, particularly those with an integrally formed flange and sleeve, typically involves a certain amount of scrunch or forcing. Following the installation of the protectors at either side of the upstanding coil, a somewhat elaborate wrapping machine is brought to bear, often having mating U-shaped components, which join together with one leg extending through the open core of the coil, whereupon a moving shuttle carries out a wrapping of the coil and protector combination. Because the retention of the core protector components may be unstable standing alone, they often are retained in position by bending straps during this shuttle movement based wrapping procedure. At the termination of the wrapping procedure, the coil then is available for manipulation by the earlier-noted overhead crane manipulated L-shaped engaging implements with the avoidance of deformation of the inner coil layers.

Figure 1:
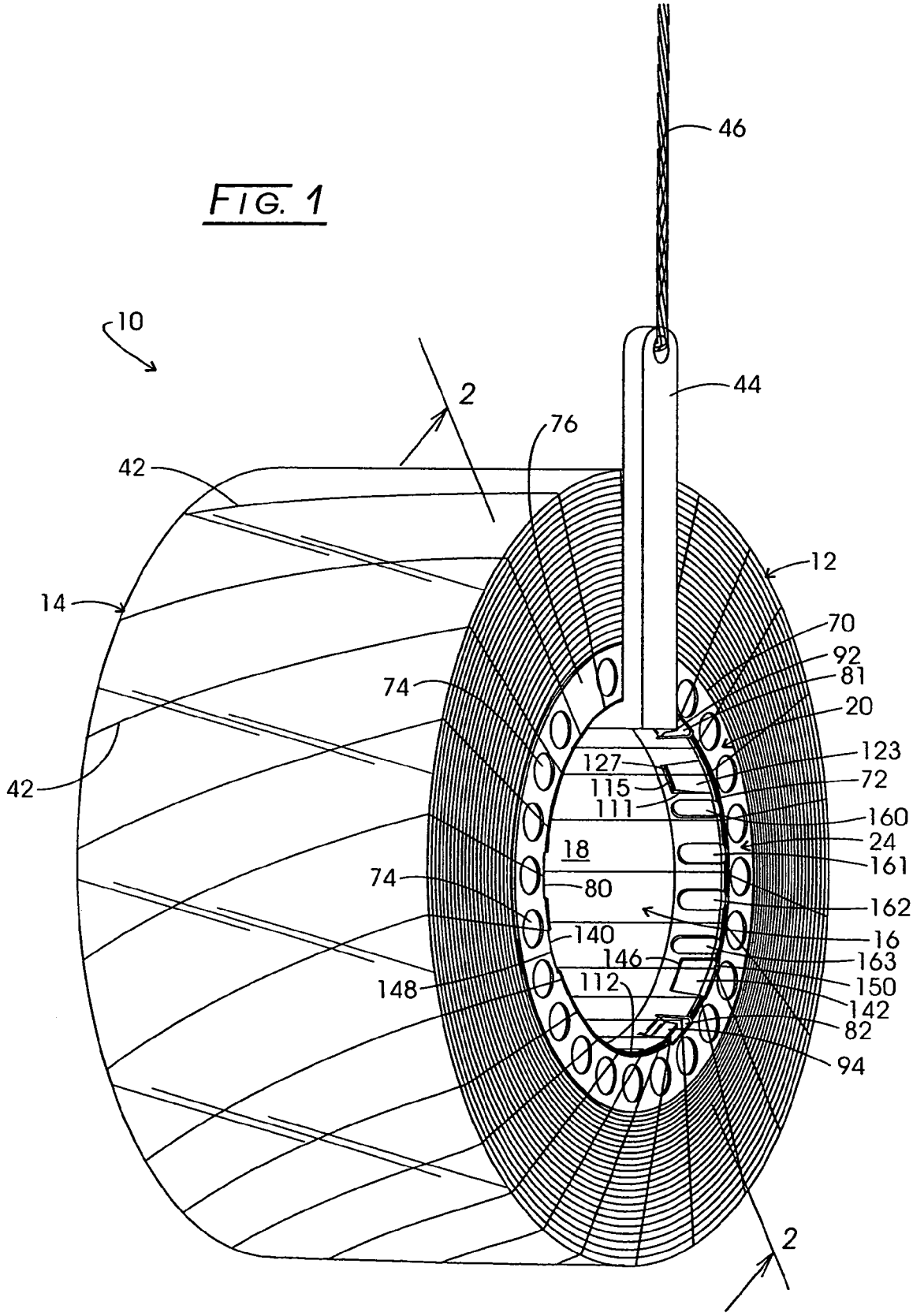
FIG. 1 is a perspective view of a coil of sheet metal incorporating protectors according to the invention and being maneuvered by a crane suspended L-shaped implement.

Referring to FIG. 1, this stage of the manufacturing process is illustrated. In the figure, the coil represented generally at 10 is seen to have oppositely disposed spaced apart edges 12 and 14 which extend about an open, generally cylindrically shaped core represented generally at 16. Looking additionally to FIG. 2, core 16 is seen to have a core surface represented generally at 18 exhibiting an internal core diameter represented in FIG. 2 at $C_d$. As noted above, when this core is standing upright upon a cradle or skid, core surface 18 may become slightly non-circular and, of course, tolerance variations will be present with respect to the winding of any given sheet metal coil over any respective mandrel. The figures at hand show that the coil 10 has been provided with protectors represented generally at 20 and 22 which are formed having outwardly disposed annular-shaped polymeric flanges respectively represented at 24 and 26. Integrally formed with and inwardly (toward the center of the coil) depending from the flanges 24 and 26 are respective sleeves represented in general at 28 and 30. The outer surfaces of these sleeves are shown respectively at 32 and 34 in FIG. 2. Note that as these surfaces extend inwardly from the flanges 24 and 26, they exhibit a generally converging taper to respective sleeve edges 36 and 38.

Figure 2:
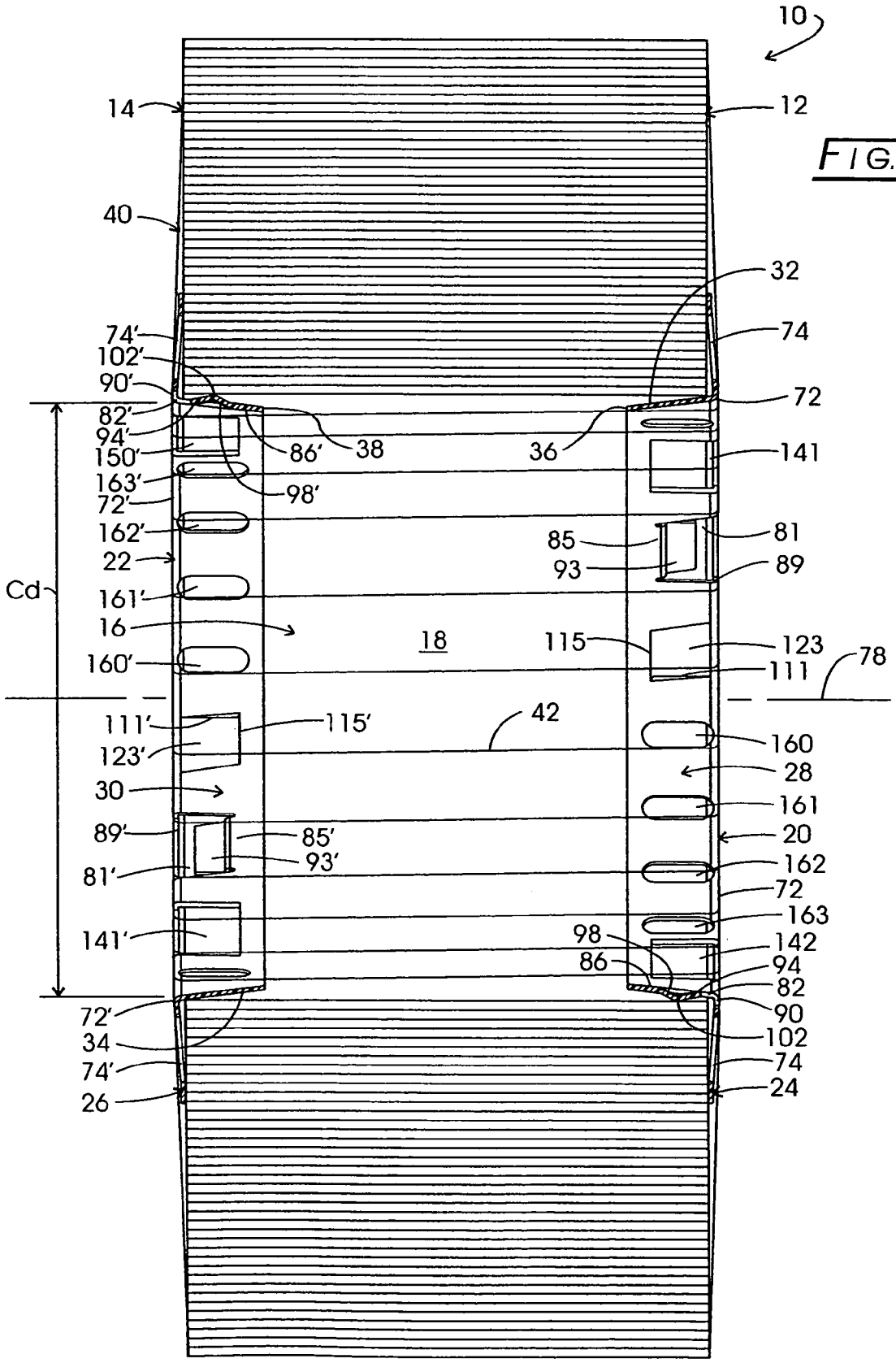
FIG. 2 is a sectional view taken through the plane 2—2 in FIG. 1.

FIGS. 1 and 2 further reveal that the coil 10 has been wrapped in a protective wrap represented generally at 40, certain of the wrap edges being represented at lines identified at 42. The wrapped and protected coil 10 is shown in FIG. 1 being engaged by the L-shaped engagement component 44 and associated cable 46 of an overhead crane (not shown).

Figure 3:
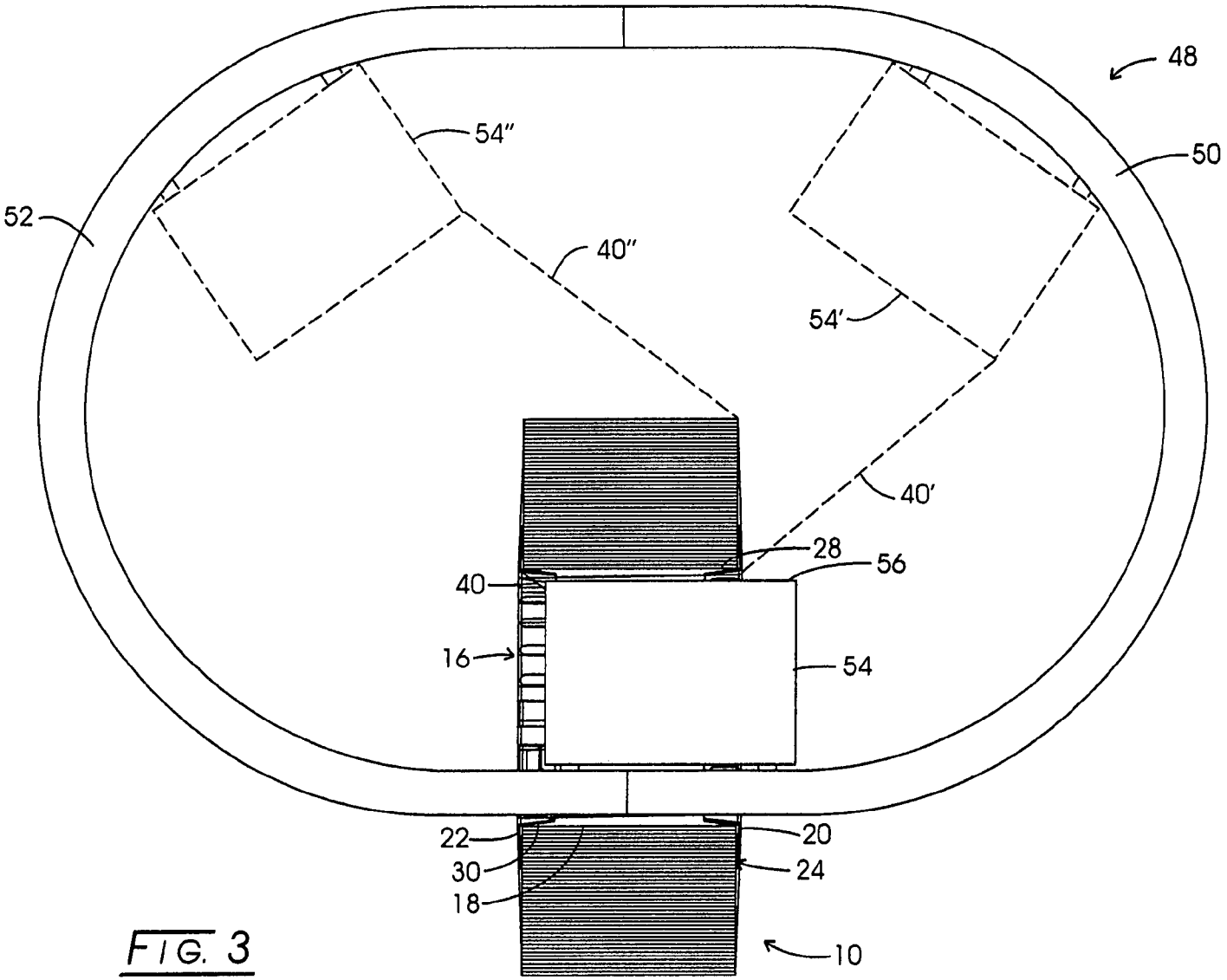
FIG. 3 is a schematic representation of a coil wrapping assemblage.

FIG. 2 reveals that the axially inward taper of the sleeve outer surfaces 32 and 34 is of an extent which facilitates the insertion of the protectors 20 and 22 into the core 16. The converging taper also promotes the important stackability of the protectors. However, observing the necessary coil maneuvering function, the taper cannot be so severe as to interfere with the basic function of the protector to protect the inwardly disposed layers of sheet metal. Additionally, this taper may not be so severe as to interfere with the procedure wherein the equipment providing the wrap 40 would be interfered with. This also applies to any axially inwardly directed appendages which may extend from the sleeves at 28 or 30. This aspect of the protector design is illustrated schematically in connection with FIG. 3. Looking to the figure, a two component ovular track is shown generally at 48 formed of tracks 50 and 52. Riding internally within track 48 when components 50 and 52 are closed together through the core 16 of coil 10 is a shuttle or carriage 54 which progressively wraps material 40 about the coil 10 as represented in phantom at 54' and 54". In this regard, note that the wrap extending from the shuttle 54 at 54' is shown at 40' and, correspondingly, is shown at 40" when the shuttle 54 is at the location shown in phantom at 54". When the components 50 and 52 of the track 48 are brought together as shown in the figure so as to extend through the core 16, limitations on the protectors 20 and 22 and particularly the respective sleeves 28 and 30 become apparent observing the inward surface 56 of the shuttle 54.

Figure 4:
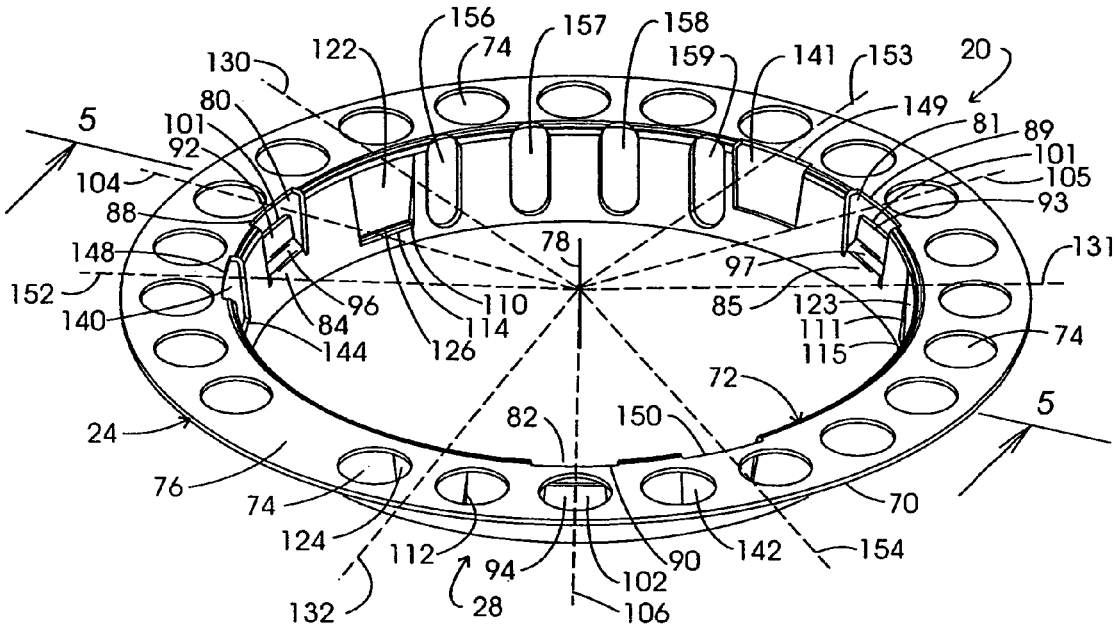
FIG. 4 is a perspective view of a protector according to the invention.
Figure 5:
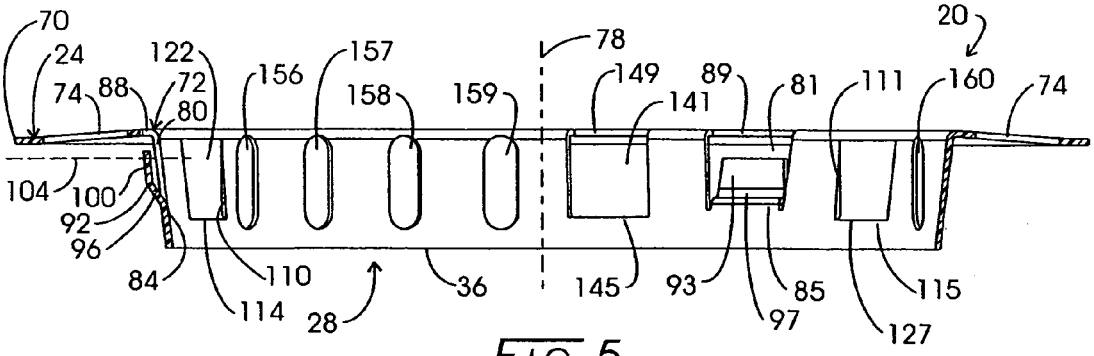
FIG. 5 is a sectional view of the protector of FIG. 4 taken through the plane 5—5 shown therein.

Returning to FIGS. 1 and 2 and looking additionally to FIGS. 4 and 5, salient features of the protectors 20 and 22 as are associated with both insertability within the core 16, material minimization based cost reduction, and important stackability for protector shipment are revealed. In FIG. 2, inasmuch as these features are identical from protector to protector, they are identified initially with respect to protector 20 and in primed fashion with respect to protector 22 in FIG. 2. FIGS. 1 and 4 reveal that the flange 24 extends from an outwardly disposed edge 70 to an inwardly disposed generally annular-shaped ridge portion 72. as represented in FIG. 2, the outwardly disposed surface of the ridge exhibits a ridge diameter which generally corresponds with the core diameter, $C_d$ described in connection with FIG. 2. That diameter is selected as being effective for facilitating a nesting insertion against the core surfacing 18 (FIG. 2). Flange 24, as well as that of all of the protectors including that shown at 26 in FIG. 2, are configured having a plurality of weight reduction flange openings certain of which are shown at 74. Note that there is a small region having no such opening 74 in the flange at 76. These openings 74 function to lower of the weight of the protectors and, importantly, lower their material cost without the sacrifice of effectiveness. For the flanges, as at 24, the openings 74 constitute a reduction in surface area of about 22% and that, in turn, corresponds with a material reduction cost saving of about 14%.

Sleeves 28 and 30 are inwardly open insertion sleeves which have a top portion integrally formed with the ridge portion 72 and extend along the central axis 78 from the flange and the sleeve with the noted converging taper a sleeve length to the earlier noted sleeve edge 36 with respect to sleeve 28 and ledge 38 with respect to sleeve 30. For the preferred embodiment, each sleeve as, for example, at 28 is configured with three generally rectangularly shaped stacking tab access openings 80–82. Openings 80–82 extend from lower sides shown respectively at 84–86 and are spaced outwardly from the sleeve edge 36 through the ridge portion 72. In the latter regard, note the respective openings 88–90 in the ridge portion 72 with respect to stacking access openings 80–82. These openings 88–90 in addition to providing an access to stacking tabs for stacking purposes, also reduce the rigidity of the ridge portion 72 to contribute to a capability of the earlier described scrunch or contraction feature permitting its facile insertion within the core 16 while retaining effectiveness for protecting the inner layers of the sheet steel core.

For the instant embodiment, within the stacking access openings 80–82 there are three respective outwardly extending resilient, core surface engagement fingers shown respectively at 92–94. In this regard, fingers 92 and 93 are seen in FIGS. 4 and 5 while finger 94 is seen in FIG. 2. Each of the fingers 92–94 is integrally formed with sleeve 28 and extends radially outwardly from sleeve axis 78 to define a stacking receiver surface which extends angularly radially and axially outward as shown respectively at 96–98. From the stacking receiver surfaces 96–98, each of the respective fingers 92–94 extend somewhat parallel with sleeve axis 78 to define camming surfaces 100–102 which function to resiliently engage core surface 18 when protectors 20 and 22 are inserted within the core 16 as shown in FIGS. 1 and 2.

Fingers 92–94 serve three functions. Initially, the camming surfaces 100–102 thereof serve to engage the internally disposed core surface 18 to retain the protectors 20 and 22 in position without the continued aid of a mill attendant while the protective wrap 40 is applied to the coil 10. Next, the fingers 92–94 serve to center or uniformly align the sleeves 28 and 30 within the core 16. This further serves the necessary accommodation to tolerance variations both in formation of the protector as well as the core 16 surface 18.

FIG. 4 reveals that the stacking access openings 80–82 and corresponding fingers 92–94 are arranged in a symmetrical pattern identified by respective radii 104–106 which are mutually angularly spaced apart at 120° intervals. This preferred arrangement provides for the noted centering function and also forms a part of the necessary stacking feature of the protectors at hand wherein the number of units to be stacked without encountering sticking phenomena or the like is substantially enhanced over plastic protectors heretofore employed.

Figure 7:
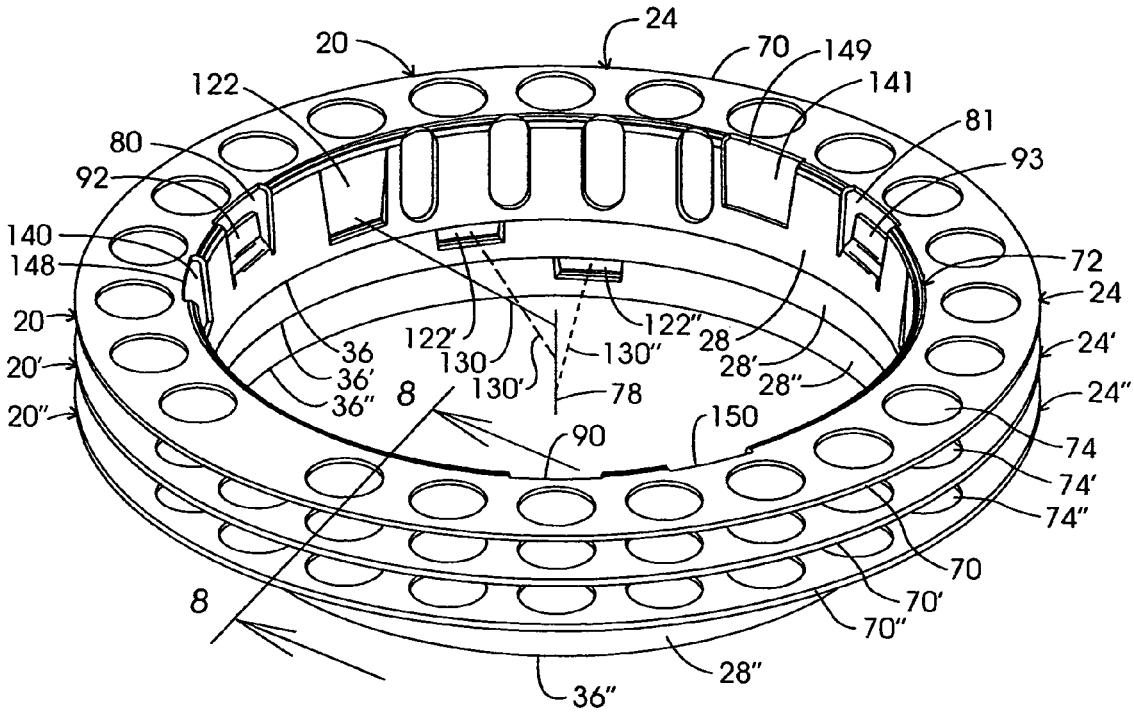
FIG. 7 is a perspective view of an assemblage of protectors according to the invention showing them in mutually stacked relationship.
Figure 8:
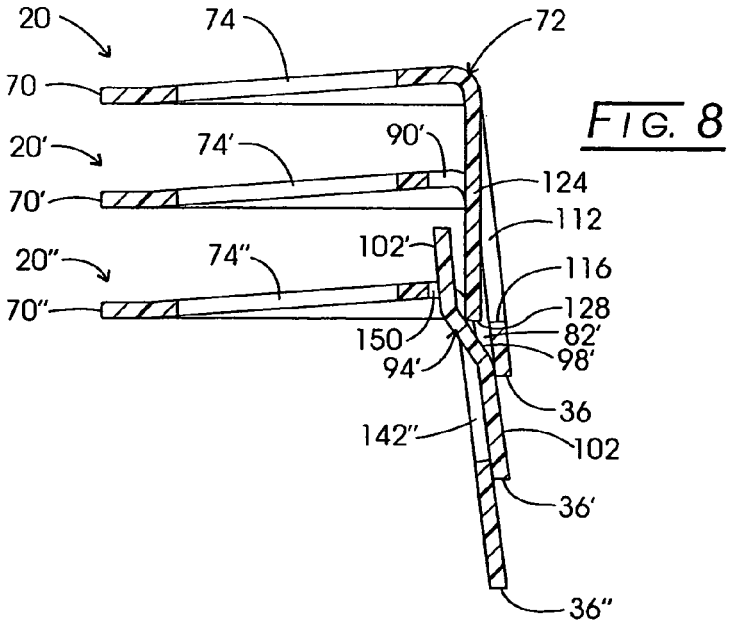
FIG. 8 is a sectional view taken through the plane 8—8 in FIG. 7.

Positioned in spaced adjacency with respect to the stacking tab access openings 80–82 are three stacking tab openings shown respectively at 110–112. Openings 110–112 extend from a lower threshold or edge shown respectively at 114–116 (Stacking tab opening 112 is seen additionally in FIG. 1. Edge 116 is shown in FIG. 8). These lower thresholds or edges 114–116 are spaced in adjacency with the sleeve edge 36 and extend upwardly to the vicinity of ridge portion 72. Extending inwardly from that ridge portion 72 and angularly oriented radially outwardly from the threshold or edges 114–116 are three stacking tabs 122–124 integrally formed with the sleeve 28 and the flange 24 in the vicinity of ridge portion 72 and extending inwardly but radially angularly outwardly to an engagement surface respectively identified at 126–128. (Engagement surfaces 126 and 127 are seen in FIGS. 4 and 5, while engagement surface 128 in connection with stacking tab 124 and stacking tab opening 112 are shown in FIG. 7).

FIG. 4 shows that both the stacking tab openings 110–112 and the corresponding stacking tabs 122–124 are arranged within a symmetrical pattern represented by respective radii 130–132 which are mutually arranged at angular intervals of 120°. Thus, this symmetrical pattern corresponds with the symmetrical pattern of the fingers as represented at radii 104–106. However, the symmetrical pattern corresponding with the stacking tabs and stacking tab openings is shifted from the symmetrical pattern associated with the fingers to space the stacking tabs 122–124 from the fingers 92–94.

Spaced from and at the opposite side of fingers 92–94 are three stacking openings shown respectively at 140–142. The inward edges of stacking openings 140–142 are spaced outwardly from sleeve edge 36 as represented respectively at 144–146. The stacking openings 140–142 extend from these respective edges 144–146 through the ridge portion 72 as represented at respective ridge openings 148–150. Stacking openings 140–142 are seen to have a generally rectangular edge configuration which is dimensioned for the purpose of stacking to insertably receive the fingers 92–94 of additional protectors 20 when they are arranged in stacking relationship for shipping purposes. As evidenced by radii 152–154 emanating from axis 78 and extending through the respective stacking openings 140–142, these openings are arranged within a symmetrical pattern which corresponds with the symmetrical pattern described in connection with fingers 92–94 as well as in connection with stacking tabs 122–124. This symmetry and a consistent spacing of these three components for alignment and stacking achieves the opportunity for a relatively close nesting stacking of the protectors 20 for shipping and storage. In this regard, the converging taper of the sleeve 28 is selected both for the noted coil inner surface protective purposes as well as to avoid sicking or the development of a holding taper which otherwise would defeat the highly desirable stackability feature. For a typically encountered protector suited for rolled sheet steel coils, a shipping stack of protectors of about 100 high becomes available which represents an improvement of about twice the stackable number of the earlier plastic protectors.

The plastic protectors in general are formed by injection molding and produced using a high density polyethylene. To remain commercially viable, the cost of the protectors must be maintained as low as possible and this, inter alia, involves a minimization of the plastic material employed in their production. While plastic recycling is available and utilized with the protectors at hand, minimization of the amount of the plastic employed in their fabrication is quite important. Additionally, the devices must be capable of accommodating tolerance variations, for example, by incorporating the earlier-described scrunch approach wherein the circumferential extent of the ridge portion 72 may be readily diminished for manual insertion into coils 10 without invading the protective integrity of the protectors and while maintaining the resilient holding positioning aspect eliminating the need for an additional mill attendant. With respect to the sleeve 28, these features are realized, inter alia, with the presence of a plurality of releaf openings which are positioned intermediate the symmetric grouping of fingers 92–94, stacking tabs 122–124, and stacking openings 140–142.

Figure 6:
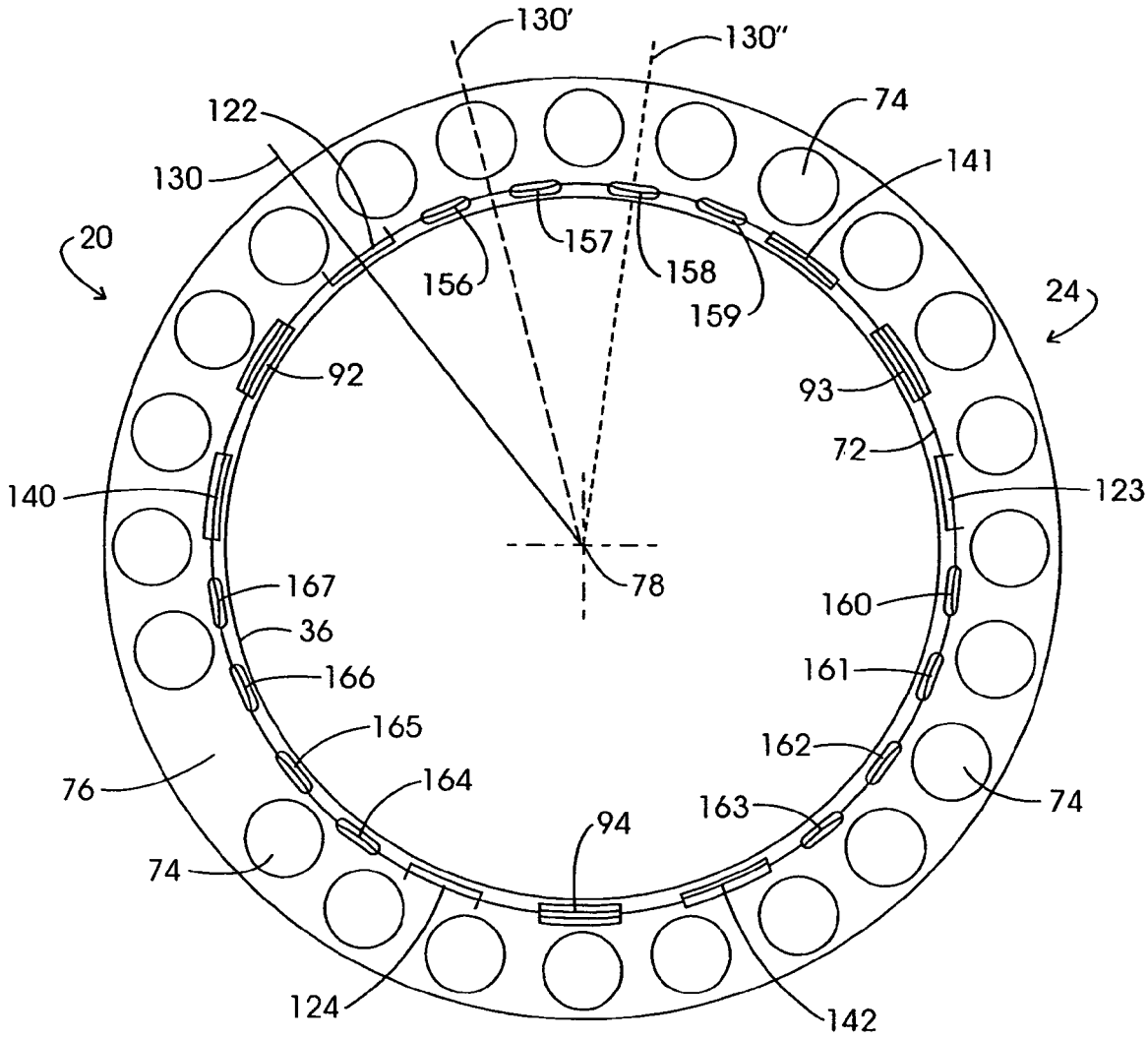
FIG. 6 is a top view of a stacked assemblage of protectors according to the invention.

An initial four such relief openings are shown in FIG. 4 at 156–159 extending between stacking tab 122 and stacking opening 141. Note that the elongate openings 156–159 extend from a location spaced from but adjacent to sleeve edge 36 outwardly through the ridge portion 72. As such, the relief openings 156–159 remove material without deleteriously affecting the functionality of the protector as it is employed to protect the inner sheet steel components of a coil 10. FIG. 2 reveals an additional four such relief opening 160–163 which are formed between stacking tab 123 and stacking opening 142. The stacking top view of FIG. 6 illustrates the upper portion of all of the relief openings 156–167. In this regard, note that in the figure, relief openings 164–166 extend between stacking tab 124 and stacking opening 140. These relief openings, in addition to functioning to provide at least a partial discontinuity at the ridge portion 72 also provide an important material reduction, the surface area. In general, the protectors will have a thickness ranging from about 0.100 inch to about 0.125 inch. Of course, further reduction in the material is provided, for example, by the presence of the stacking openings 140-142 as well as a lesser reduction in material as developed in connection with the formation of stacking tab access openings 80-82.

Now considering the stacking features of the protectors 20, it is essential that the protectors be mutually stackable one upon the other in practical, closely nested fashion without the evocation of sticking phenomena which would defeat the stacking feature in the first instance. Additionally, stacks of the protectors 20 should incorporate a structural integrity such that the stacks will retain their verticality during shipment and storage, i.e., they will not slope or droop. Generally, such lack of verticality occasioned by a mutual slippage between the stack protectors. Accordingly, in accordance with the present invention, this slippage in stacked assemblages of the protectors is eliminated with a geometry which overcomes inherent tolerance variations in the manufacture of these plastic molded devices. This is achieved through the above-discussed combination of symmetrically disposed fingers as at 92–94; symmetrically disposed stacking tabs 122–124; and symmetrically disposed stacking openings 141–142.

Looking to FIG. 6, a top view of a stacked assemblage of three protectors 20 is illustrated, only the topmost one of the devices 20 being generally visible from this viewpoint. Accordingly, the topmost protector is represented at 20 along with the earlier-described radius 130 extending across the center of stacking tab 122. In order to stack the protector 20 upon a next lower protector, the stacking tab 122 is inserted within the stacking tab access opening 80 of the lower protector such that its stacking tab lower threshold or edge as at 114 (FIG. 4) engages the finger 92 of the stacking openings 140–142 of this next lower protector. As stacking progresses by a rotational shifting of the protectors from one layer to the next, it is necessary to accommodate the outward extending fingers, for example, as at 92. This is accomplished through the utilization of the stacking openings as for example at 140, the finger of an upper protector falling within this opening of a lower protector. In FIG. 6, this rotational offsetting shifting is represented by observing, for example, the radius 130 of a topmost protector being shifted counterclockwise from the corresponding radius 130' of a next lower protector which, in turn, has been shifted in a counterclockwise manner with respect to a third lower protector as represented by the radius 130".

Turning to FIG. 7, such an assemblage is represented in perspective fashion wherein the upper protector is identified at 20, the next lower protector in the stacked assemblage is represented at 20', and the third lower protector in the stacked assemblage is represented at 20". The earlier described radii 130, 130', and 130" again are reproduced in the instant figure but shown in conjunction with their elevational orientation with respect to the common central axis 78. As indicated earlier, the radius 130 is considered to extend through the center of a stacking tab 122. To facilitate the stacking description, the same identifying numeration is retained for the lower protectors of the stack but in progressively primed fashion. FIG. 8 reveals the stacking relationship at the section 8—8 in FIG. 7. Looking to that figure, it may be observed that the lowermost protector 20" is illustrated in connection with its stacking opening 142" and ridge opening 150". Extending within this stacking opening 142', is the finger 94' of the next upwardly disposed protector 20'. The stacking tab 124 of the highest protector 20 in the stack is shown having its lower engagement surface 128 sitting in freely abuttable contact with the stacking receiver surface 98' of protector 20'. This protector stacking relationship reoccurs or is repeated, for example, three times in view of the preferred symmetrical pattern described above in connection with FIG. 4.

Figure 9:
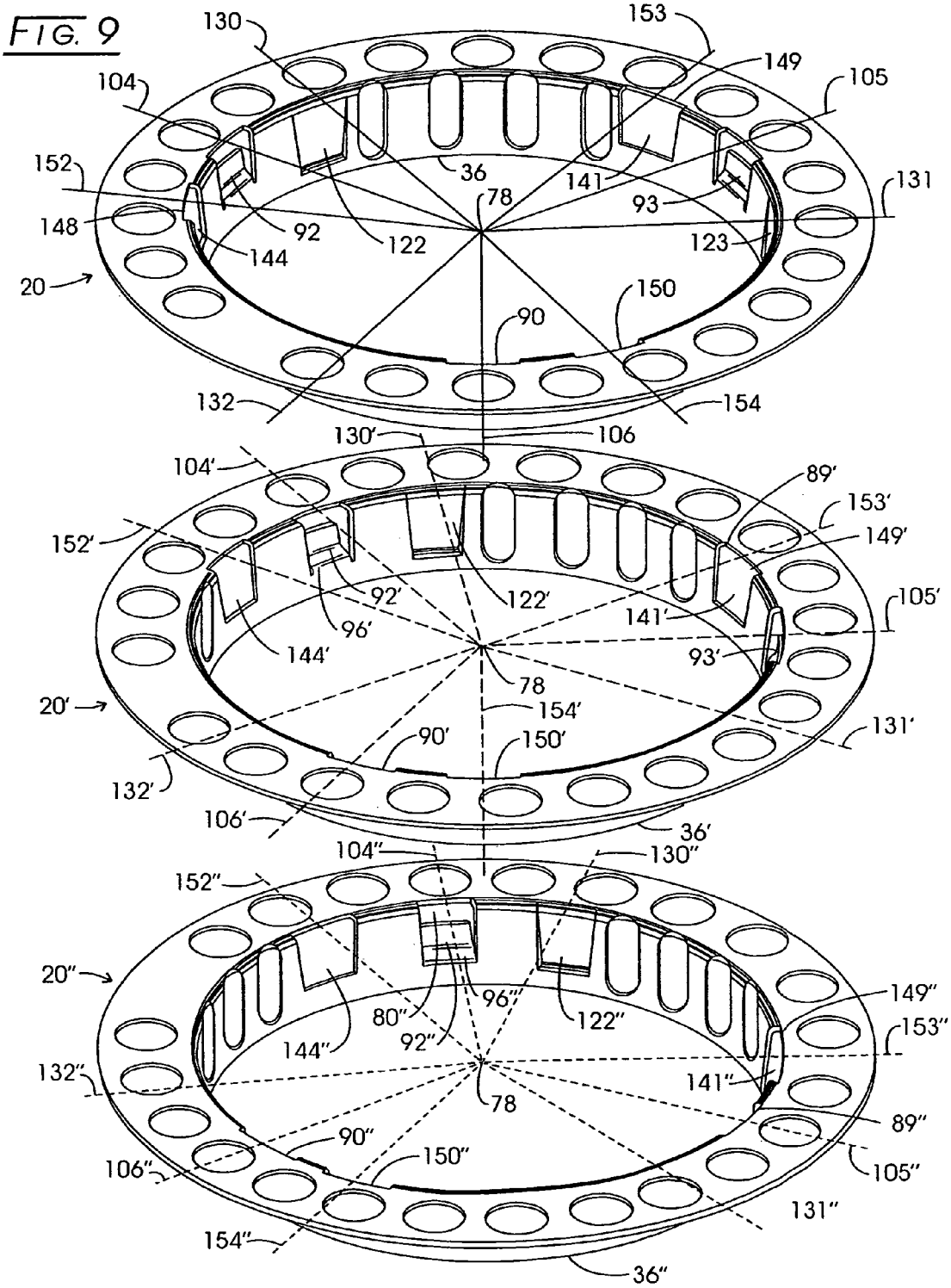
FIG. 9 is an exploded view of the protector stacked assemblage shown in FIG. 7.

Referring to FIG. 9, protectors 20, 20', and 20" as described in connection with FIG. 7 are reproduced but spaced apart in exploded fashion. The figure further includes the radii described in connection with FIG. 4 and identified in the primed numerical stacking order discussed above. Assuming that the protector 20" is the lowermost one of the stack which is placed upon a pallet, skid or like support as a lowermost protector, then the next protector to be stacked is that at 20'. Note that its radii are displaced by the spacing distance between two of the stacking elements as at 144', 92', and 122'. In this regard, the stacking tab 122' will be received within stacking tab access opening 80" and the finger 92' will be received within the stacking opening 144". Inasmuch as each of the protectors 20, 20', and 20" are identical, this same arrangement will occur with respect to components at radii 153', 105', 131'; and 154', 106' and 132'. Following positioning of protector 20' upon protector 20" then protector 20 may be positioned upon protector 20'. For example, stacking tab 122 will engage the stacking receiving surface 96" of protector 20' and the finger 92 will fall within the stacking opening 144'. As before, the same nesting relationship will occur with stacking functional components located at radii 153, 105, 131; and 154, 106, and 132.

While symmetry about the axis 78 is a preferred arrangement for the stacking functional components of the protectors, the protectors will stack if the arrangement is unsymmetrical. A three point stability patterning of these components is desirable to assure the integrity of the verticality of stacking. Of course, less than that number may be utilized at the risk of instability and more may be utilized with attendant potentially increased cost.

Figure 10:
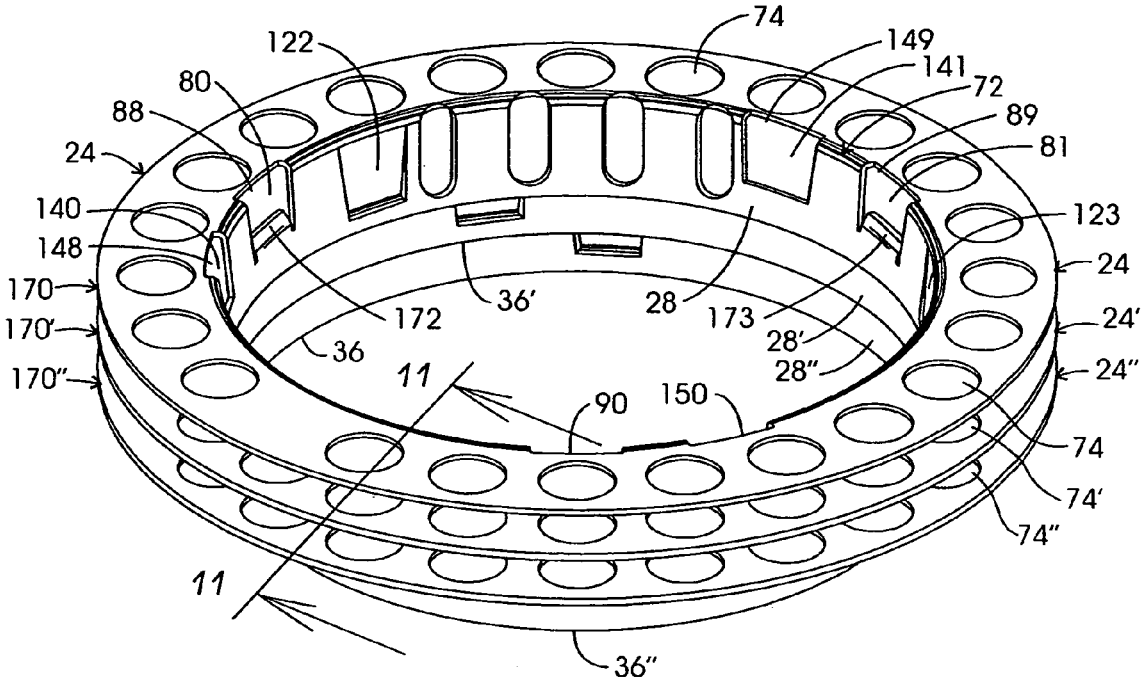
FIG. 10 is a stacked assemblage of protectors according to the invention showing an alternate finger component design.
Figure 11:
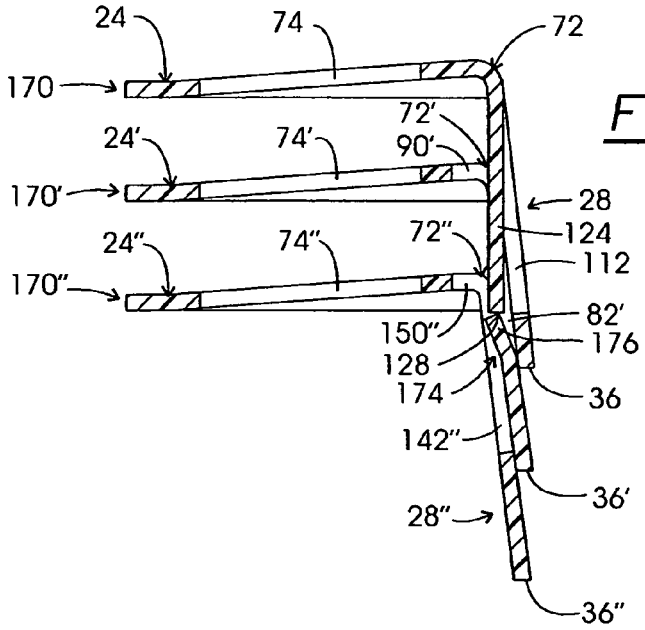
FIG. 11 is a sectional view taken through the plane 11—11 in FIG. 10.

For some mill installations, it has been found desirable to modify the fingers earlier described at 92–94 such that the camming surfaces 100–102 are eliminated, the finger is extending to the tip of the earlier described stacking receiver services 96–98. Referring to FIGS. 10 and 11, such modification is revealed. Where components of this embodiment remain the same as those described in connection with FIGS. 1–9, then their numeration is retained in the instant figures. Additionally, in the identification of the stacking arrangement, the primed form of identification regimen is retained.

Looking at FIG. 10, three stacked protectors are shown in general at 220, 220'; and 220". As before, the protectors are comprised of flanges represented generally at 24, 24', and 24" which are integrally formed through a ridge portion as seen in connection with protector 220 with an integrally formed sleeve as represented at 28, 28', and 28". These sleeves extend from the ridge portion, for example, at 72 to sleeve edges 36, 36', and 36". Spaced around each of the flanges 24, 24' and 24" are plurality of weight reduction flange openings, certain of which are represented at 74, 74' and 74". Seen in FIG. 10, for example, are stacking openings as at 140 and 141 which are associated with respective ridge openings 148 and 149. A third ridge opening is shown at 150. Spaced from and adjacent to the stacking openings as at 140 and 141 are stacking tab access openings two of which are shown at 80 and 81 which are associated with respective ridge portion openings 88 and 89, the corresponding ridge opening for the third stacking functional component grouping being shown at 90. Two stacking tabs are revealed at 122 and 123. As before, stacking tab 124 will be adjacent to but spaced from the ridge opening 90. Two of the three modified fingers are shown in FIG. 10 at 172 and 173, the third, 174, being shown in sectional fashion in connection with FIG. 11. Looking to that figure, it may be seen that finger 174 extends angularly radially outwardly from the sleeve 36' to define a stacking receiver surface 176 which evolves as an edge for the instant demonstration. Note that the engagement surface 128 of stacking tab 124 engages a receiving surface 176 in stacking relationship.

Figure 12:
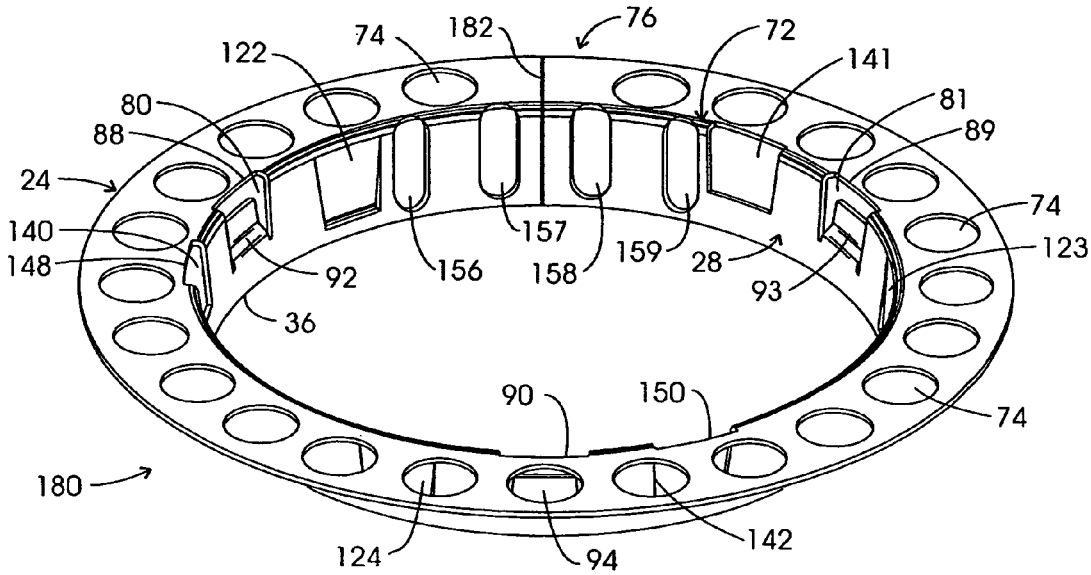
FIG. 12 is a perspective view of a protector according to the invention showing an alternate embodiment.

For some applications, mill operators are desirous of providing the protectors 20 in a configuration where they are fully slotted through the flange 24, ridge portion 72, and sleeve 28 such that they can be parted slightly in the course of their installation within a core 16. Looking to FIG. 12, such an arrangement is provided. In the figure, as before, components common with FIGS. 4–9 are identified with the same numeration. In the figure, the protector 180 is seen having such a parting slit 182 extending generally centrally through the region 76.

Figure 13:
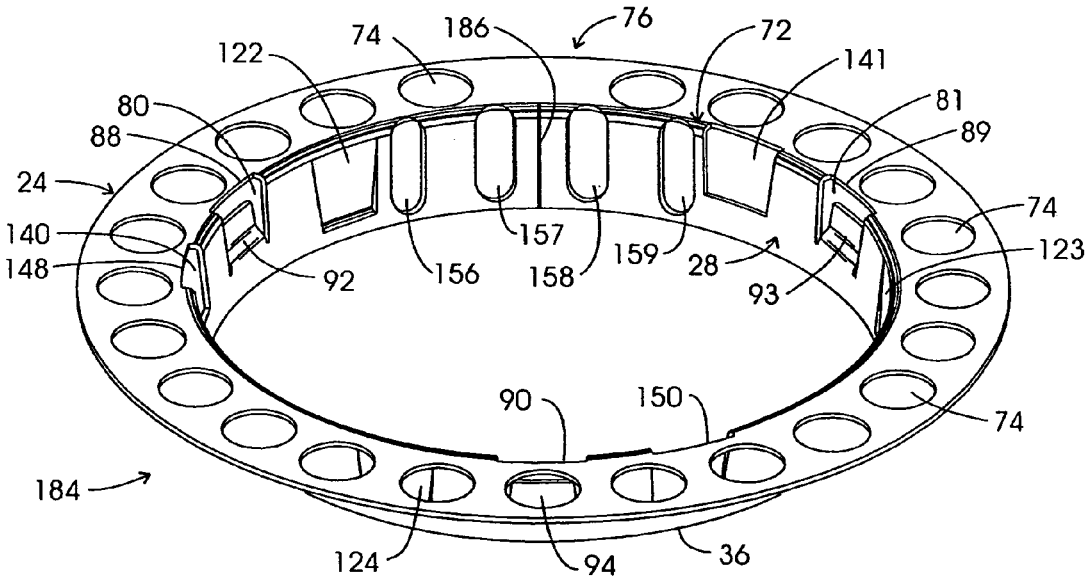
FIG. 13 is a perspective view of a protector according to the invention showing an alternate embodiment.

Another adaptation of the protectors 20 involves utilization of the protectors in a mill facility wherein the metal rolls, when wound about a mandrel will exhibit an upstanding but short axially protruding sheet portion which will have engaged a slot within the mandrel and which protrudes axially inwardly upon removal of the mandrel. FIG. 13 shows an adaptation for accommodating this protrusion. In the figure, a protector is represented generally at 184 and, as in the case of FIG. 12, components in common with those described in connection with FIGS. 1–9 are identified with the same numeration. However, at region 76 it may be observed that a slot 186 which extends from the ridge portion 72 through the edge 36 is provided facilitating the mounting of protector 184 within a core having the noted protrusion.

Figure 14:
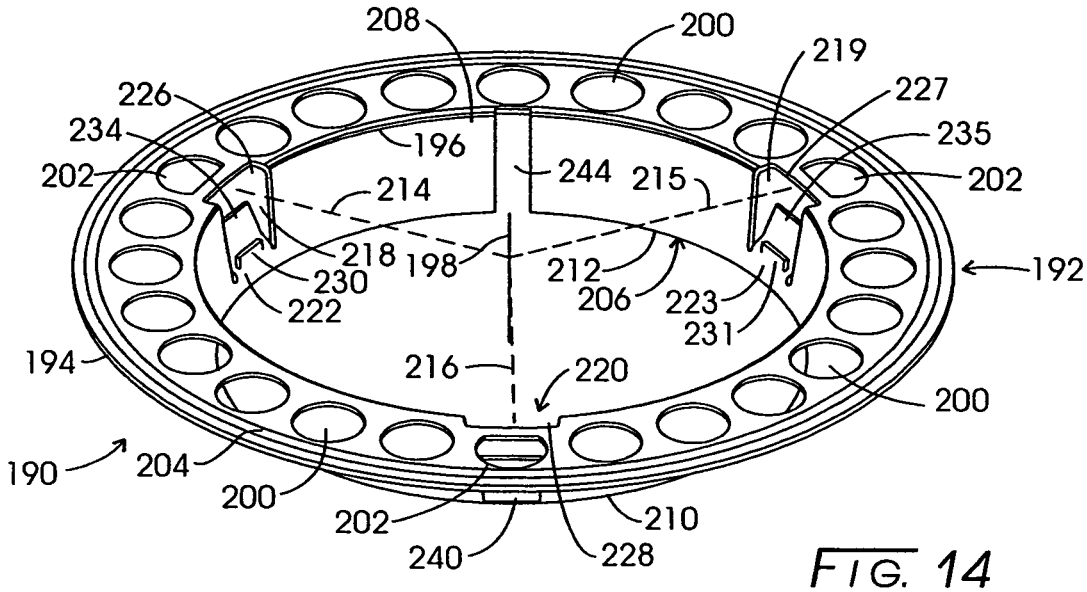
FIG. 14 is a perspective view of a protector according to the invention.
Figure 16:
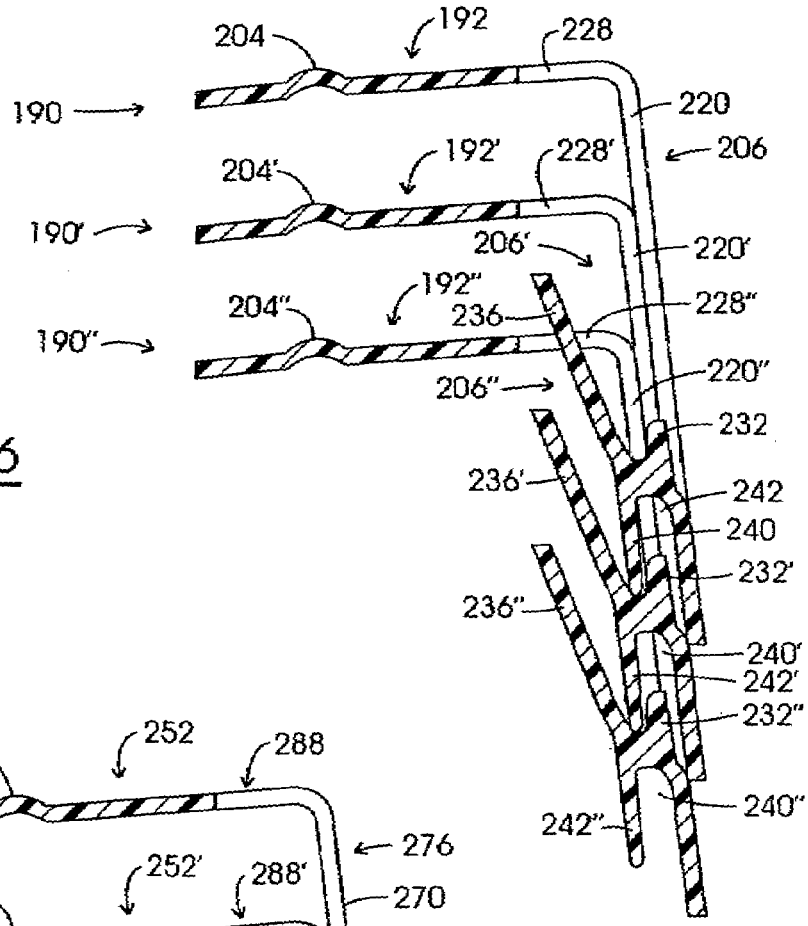
FIG. 16 is a sectional view of the protector shown in FIGS. 14 and 15.

FIG. 14 reveals another embodiment of the protector of the invention. In this regard, a protector represented generally at 190 is shown, as before, having a generally planar annular polymeric flange represented generally at 192 which extends from an outwardly disposed edge 194, a flange width to an inwardly disposed generally annular-shaped ridge portion 196. Ridge portion 196 exhibits a ridge diameter with respect to a central axis 198 which generally corresponds with the earlier-described core diameter, $C_d$. Flange 192, as before, is configured having a plurality of weight reduction flange openings certain of which are revealed at 200. It may be noted that three of the flange openings as at 202 are somewhat truncated. Flange 192 further is configured having an axially outwardly extending annular reinforcement ridge 204 which is located adjacent but radially spaced inwardly from outwardly disposed flange edge 194. The ridge 204 functions to strengthen the flange 192 against flexure. A cross section of the ridge 204 is revealed in FIG. 16.

Integrally formed with and depending from the ridge portion 196, as before, is an insertion sleeve represented generally at 206. The top portion 208 of sleeve 206 is coincident with the ridge portion 196 and has an outer sleeve surface 210 which extends axially inwardly from top portion 208 with a generally converging taper a sleeve length to an annular sleeve edge 212 exhibiting a diametric extent less than the core diameter, $C_d$.

Figure 15:
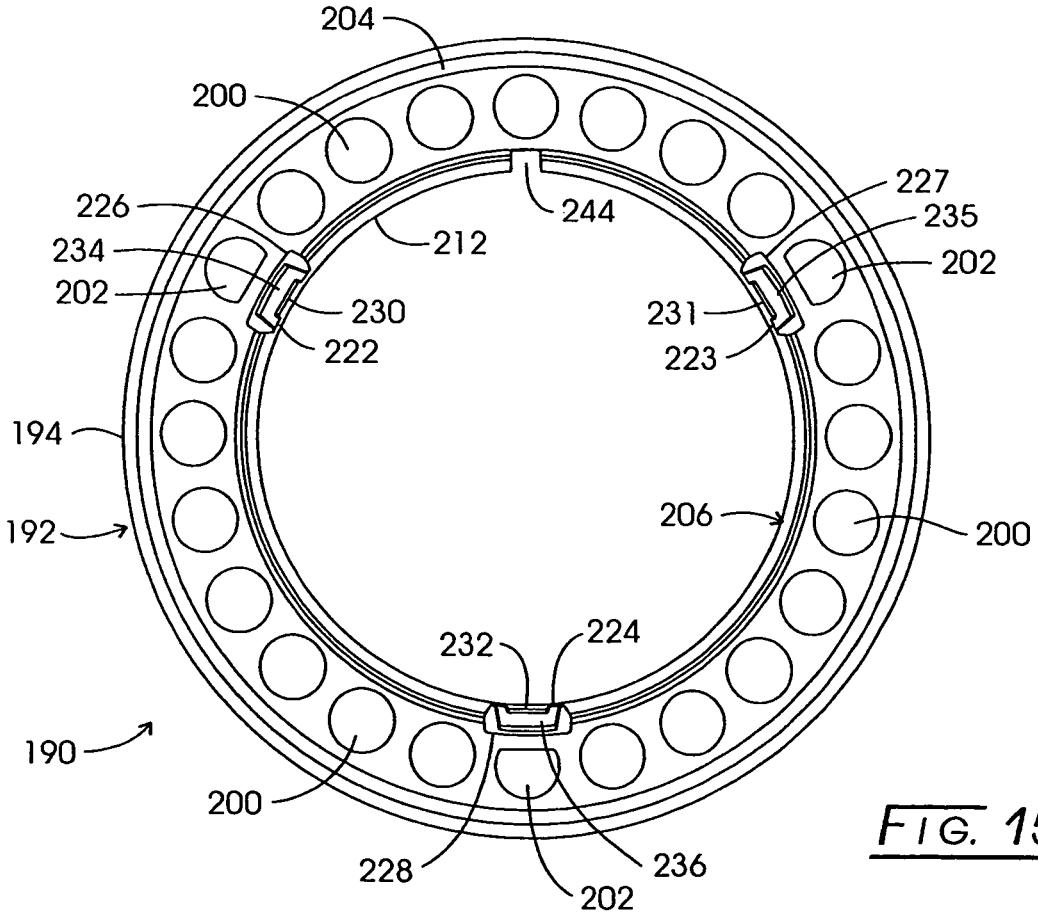
FIG. 15 is a top view of the protector shown in FIG. 14.

Symmetrically disposed about flange 192 and sleeve 206, as represented at radii 214–216, are three stacking access openings 218–220. Openings 218–220 extend axially outwardly (outwardly in the sense of outwardly from the core as at 16) from respective lower ends 222–224 (see additionally FIG. 15) located in spaced adjacency from the sleeve edge 212 through a portion of the flange 192 including the ridge portion 196. This provides the stacking offset openings 226–228 for each of the respective stacking access openings 218–220. It may be observed that these openings are accommodated for by the truncated flange openings 202. Formed integrally with and extending axially upwardly from each of the lower ends 222–224 are stacking tongues or tabs shown respectively at 230–232. As is revealed in FIG. 15, these tongues 230–232 are generally aligned with the insertion sleeve 206. With the present embodiment, additionally integrally formed with the lower ends 222–224 are radially outwardly and axially outwardly disposed surface engagement fingers 234–236 which function to resiliently engage the surface of the coil core as shown at 18 in FIG. 2.

Positioned outwardly from the outer sleeve surface 210 and axially aligned with the stacking tabs 222–224 are generally rectangularly shaped stacking sockets, one of which is shown in FIG. 14 at 240. Looking additionally to FIG. 16, a stacked assemblage of three protectors 190 is revealed. In the figure, as before, the upper protector is identified at 190, the next lower protector in the stacked assemblage is represented at 190', and the third lower protector in the stacked assemblage is represented at 190". To facilitate the stacking description, the same identifying numeration is retained for the lower protectors of the stack but in progressively primed fashion. In the figure, it may be noted that the lowermost stacking socket 240" extends radially outwardly from the insertion sleeve 206" and is configured therewith to define a receiving chamber 242". To create an interlocking stack, the stacking socket 240' with receiving chamber 242' is seen to extend over stacking tongue 232". In similar fashion, the cavity 242 of stacking socket 240 is seen to extend over stacking tongue 232'. With the arrangement, no rotational orientation of the protectors is required to carry out stacking.

Returning to FIGS. 14 and 15, it may be observed that the insertion sleeve 206 is configured having an insertion notch 244 extending from the sleeve edge 212 to the top portion 196. Notch 244 carries out the earlier-described function of the slot 186 as discussed in connection with FIG. 13.

Figure 17:
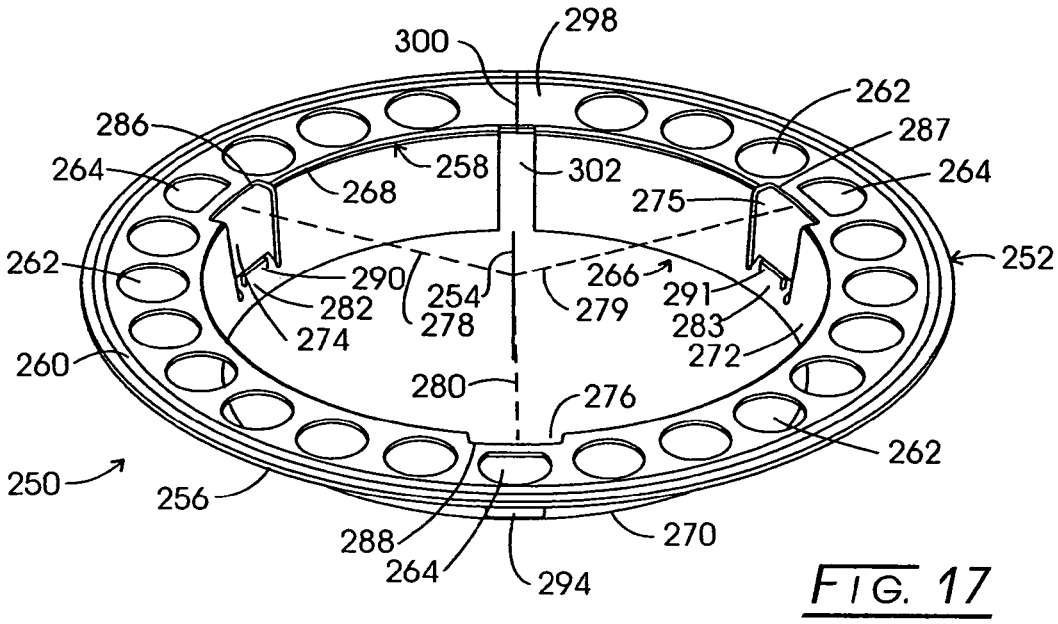
FIG. 17 is a perspective view of a protector according to the invention.
Figure 18:
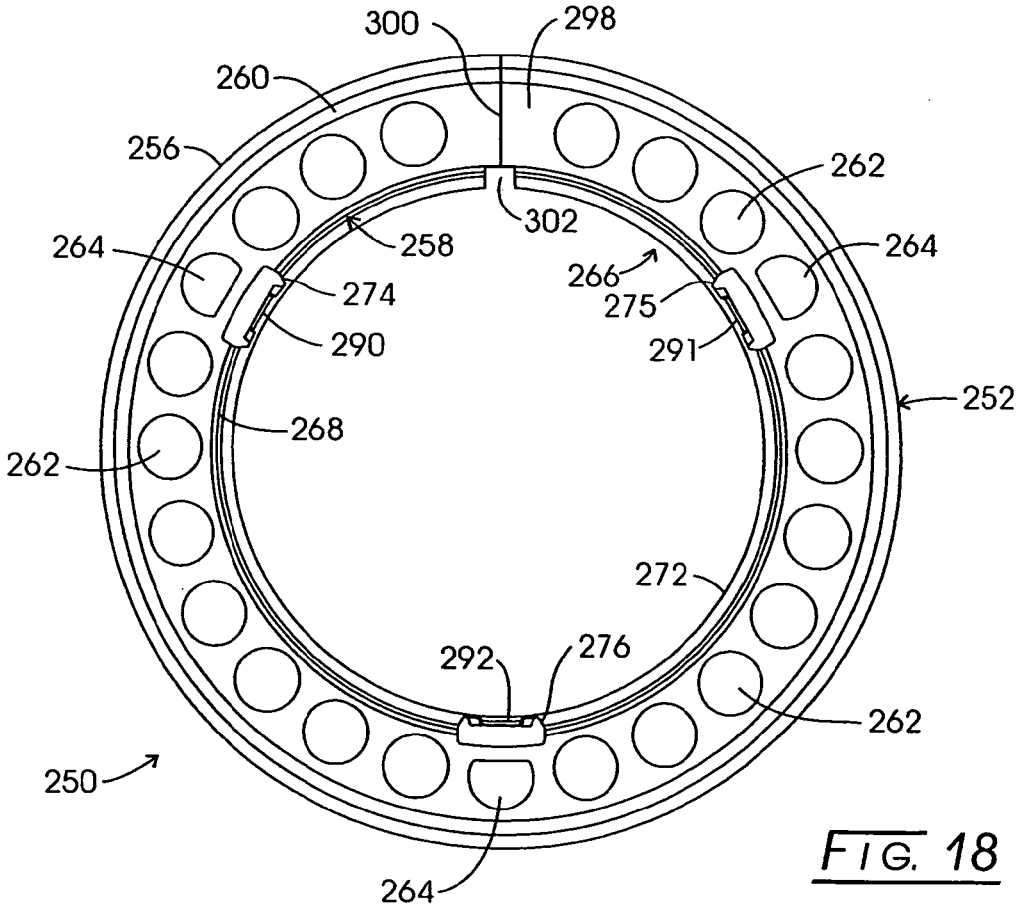
FIG. 18 is a top view of the protector shown in FIG. 17.

Referring to FIGS. 17 and 18, a variation of the protector 190 is represented in general at 250. Protector 250, as before, includes an annular, generally planar polymeric flange as is represented generally at 252. Flange 252, as before, has a central axis 254 and extends from an outwardly disposed edge 256 a flange width to an inwardly disposed generally annulus-shaped ridge portion represented generally at 258. Ridge portion 258 exhibits a ridge diameter with respect to axis 254 generally corresponding with the core diameter $C_d$. Flange 252 incorporates an axially outwardly extending annular reinforcement ridge 260, the profile of which is revealed in FIG. 19. Ridge 260 functions to reinforce the flange 252 against warpage. A plurality of weight reduction flange openings are provided within the flange 252, certain of those of circular periphery being shown at 262. As before, three of the flange openings are truncated as represented at 264.

Integrally formed with the flange 252 is an inwardly extending open insertion sleeve represented generally at 266 having a top portion 268 somewhat coincident with the ridge portion 258 and having an outer sleeve surface 270 (FIGS. 17 and 19) extending axially inwardly therefrom with a generally converging taper a sleeve length to a sleeve edge 272. According, sleeve edge 272 exhibits a diametric extent less than the core diameter $C_b$. Three stacking access openings 274–276 are symmetrically disposed about the sleeve 266 as represented by respective radii 278–280 (FIG. 17). Openings 274–276 extend from respective lower ends 282 and 284 (see additionally FIG. 19). These lower ends 282–284 are located in spaced adjacency from the sleeve edge 272 and the access openings 274–276 extend through the flange ridge portion 258 and radially therefrom to define respective stacking offset openings 286–288. As before, the offset openings 286–288 are the occasion of the truncated flange openings 264. Stacking tongues or tabs 290–292 are integrally formed with and extend outwardly from the respective lower ends 282–284 of the access openings 274–276. Aligned with the stacking tongues 290–292 are corresponding stacking sockets, one of which is revealed at 294 in FIG. 17. These sockets as at 294 extend radially outwardly from the insertion sleeve outer surface 270 and are formed having a receiving chamber or groove seen in FIG. 19 at 296.

Figure 19:
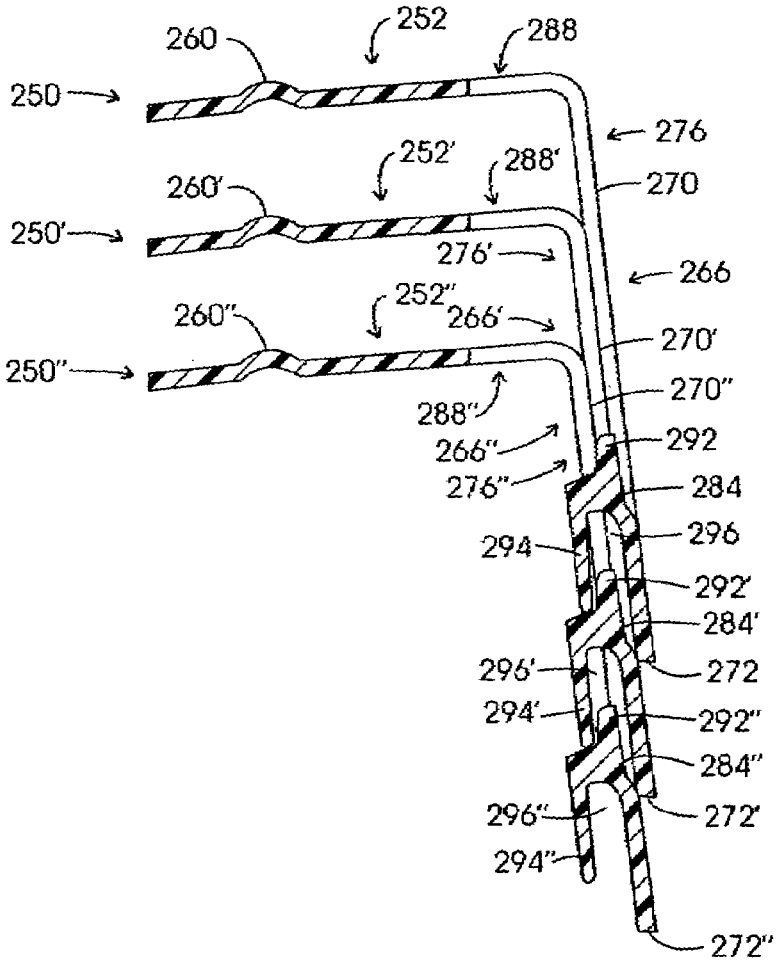
FIG. 19 is a sectional view of the protector shown in FIGS. 17 and 18.

FIG. 19 reveals the stacking relationship in an arrangement wherein the upper protector is identified at 250, the next lower protector in the stacked assemblage is represented at 250', and the third lower protector in the stacked assemblage is represented at 250". To facilitate the stacking description, the same identifying numeration is retained for the lower protectors of the stack but in progressively primed fashion. As before, the stacking approach provided with the structure as represented at FIG. 19 is one wherein no rotational alteration is required as part of the stacking process. The sockets as at 294 portray radially outwardly from the outer sleeve surface 270 and, thus, protrude a resilient retaining pressure against the inner surface 18 of the core (FIGS. 1 and 2).

Returning to FIGS. 17 and 18, it may be observed that no flange opening 262 is present at the flange region 298. A parting slit extends through the ridge portion 300 radially through flange edge 256. Communicating with the parting slit 300 is an insertion notch 302 extending to the sleeve lower edge 272 and having the same mandrel related function as earlier-described notch 244.

Figure 20:
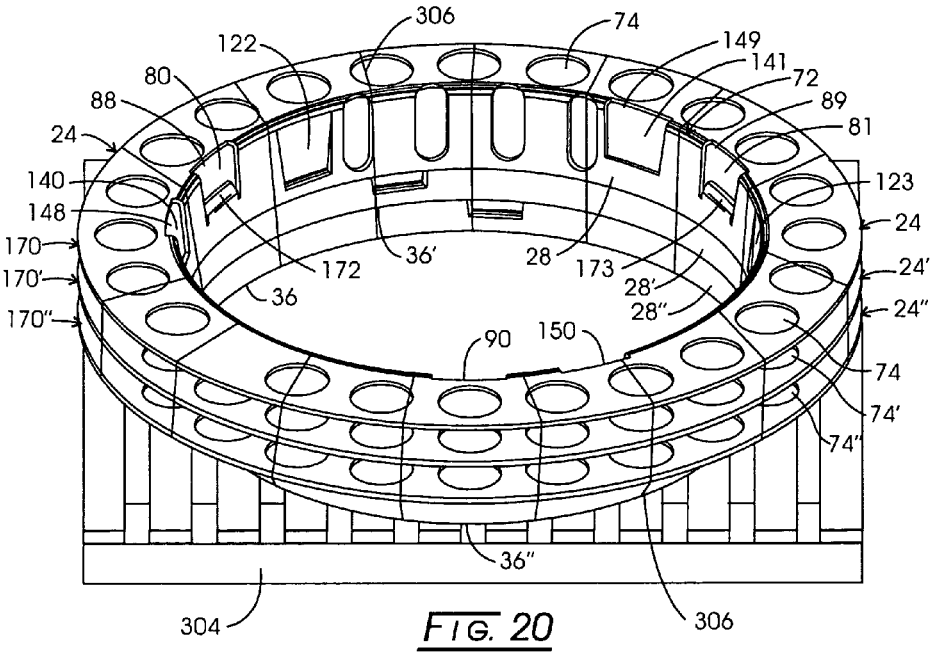
FIG. 20 illustrates the protectors of FIG. 7 compressively retained within a protective wrap and resting upon a pallet.

As shown in FIG. 20, after repeated stacking of the protectors upon a lifting surface, 304, such as a pallet, a tensioned wrap, 306, is used for enclosing the stacked assemblage of protectors upon the lifting surface, thereby compressibly retaining each protector.

Since certain changes may be made in the above apparatus and method without departing from the scope of the invention herein involved, it is intended that all matter contained in the above description or shown in the accompanying drawings shall be interpreted as illustrative and not in a limiting sense.

What is claimed is:

1. The method for providing a stacked assemblage of protectors comprising the steps of:

(a) providing a plurality of substantially identically configured protectors, each said protector having a generally planar, annulus-shaped polymeric flange having a central axis and extending from an outwardly disposed edge to an inwardly disposed generally annular shaped ridge portion, an inwardly extending open sleeve having a top portion formed integrally with said ridge portion and having an outer sleeve surface extending inwardly therefrom along said axis with a generally converging taper a sleeve length to a sleeve edge, three stacking tab access openings arranged within a first pattern within said sleeve, each extending from a lower side spaced from said sleeve edge through said ridge portion, three fingers, each having a stacking receiver surface and each said finger extending angularly outwardly from said lower side of one of said stacking tab access openings, three stacking openings arranged within a second pattern shifted about said axis from said first pattern to space said stacking openings from said stacking tab access openings and dimensioned to receive a said finger, and three stacking tabs extending along said outer sleeve surface arranged within a third pattern shifted about said axis from said first pattern to space said stacking tabs from said stacking openings and said stacking tab access openings, each said stacking tab having an engagement surface;

(b) positioning the sleeve edge of one said protector upon a lifting surface;

(c) positioning the sleeve of a next protector through the upwardly disposed ridge portion and within the sleeve of said one protector in a manner wherein the engagement surface of said three stacking tabs is inserted through aligned said stacking tab access openings to an extent wherein said engagement surface freely abuttably contacts a said stacking receiver surface and each said finger of said next protector extends through corresponding said stacking opening of said one protector; and (d) reiterating said step (c) for a succession of said protectors until the last of said plurality of protectors is positioned upon the next to last of said protectors in said stacked assemblage.

2. The method of claim 1 including the step of:

(e) enclosing said stacked assemblage of protectors upon said lifting surface in a tensioned wrap compressibly retaining each protector commencing with said next protector against an adjacent protector.

3. The method for providing a stacked assemblage of protectors comprising the steps of:

(a) providing a plurality of substantially identically configured protectors, each protector having a generally planar, annulus-shaped polymeric flange having a central axis and extending from an outwardly disposed edge to an inwardly disposed generally annular-shaped ridge portion, an inwardly extending open insertion sleeve having a top portion formed integrally with said ridge portion and having an outer sleeve surface extending axially inwardly therefrom with a generally converging taper a sleeve length to a sleeve edge, three stacking access openings within said insertion sleeve each extending from a lower end located in spaced adjacency from said sleeve edge through said flange ridge portion to define a stacking offset opening, a stacking tongue generally aligned with said insertion sleeve and extending axially outwardly from each said access opening lower end, and a stacking socket extending radially outwardly from said insertion sleeve, having a receiving chamber axially aligned with a said stacking tongue at each said access opening;

(b) positioning the sleeve edge of one said protector upon a lifting surface;

(c) positioning the sleeve of a next protector through the upwardly disposed ridge portion and within the sleeve of said one protector in a manner wherein the sockets of said next protector pass through the offset openings and receiving chambers thereof to slideably engage the corresponding tongues of said one protector; and (d) reiterating said step (c) for a succession of said protectors until the last of said plurality of protectors is positioned upon the next to last of said protectors in said stacked assemblage.

4. The method of claim 3 including the step of:

(e) enclosing said stacked assemblage of protectors upon said lifting surface in a tensioned wrap compressibly retaining each protector commencing with said next protector against an adjacent protector.

* * * * *